US012790053B2

(12) United States Patent
Fernández Sánchez et al.

(10) Patent No.: US 12,790,053 B2
(45) Date of Patent: Nov. 10, 2026

(54) METHOD AND SYSTEM FOR PLACING PRODUCTS IN BOXES

(71) Applicant: GAINDU, S.L., Elgoibar (ES)

(72) Inventors: Jose Luis Fernández Sánchez, Elgoibar (ES); Aitzol Arriola Badiola, Elgoibar (ES)

(73) Assignee: GAINDU, S.L., Elgoibar (ES)

( * ) Notice: Subject to any disclaimer, the term of this patent is extended or adjusted under 35 U.S.C. 154(b) by 0 days.

(21) Appl. No.: 19/117,718

(22) PCT Filed: Sep. 28, 2023

(86) PCT No.: PCT/EP2023/076961

§ 371 (c)(1),
(2) Date: Apr. 2, 2025

(87) PCT Pub. No.: WO2024/074406

PCT Pub. Date: Apr. 11, 2024

(65) Prior Publication Data

US 2026/0125174 A1 May 7, 2026

(30) Foreign Application Priority Data

Oct. 3, 2022 (EP) ..... 22382924

(51) Int. Cl.
*B65B 43/00* (2006.01)
*B65B 5/06* (2006.01)
*B65B 43/56* (2006.01)

(52) U.S. Cl.
CPC ..... *B65B 43/56* (2013.01); *B65B 5/068* (2013.01); *B65B 2220/16* (2013.01)

(58) Field of Classification Search
CPC ..... B65B 43/56; B65B 5/068; B65B 2220/16; B65B 35/44; B65B 5/024; B65B 43/52
(Continued)

(56) References Cited

U.S. PATENT DOCUMENTS 4,385,482 A * 5/1983 Booth ..... B65B 43/56 53/247
2016/0059972 A1* 3/2016 Nagata ..... B65B 43/185 53/446

FOREIGN PATENT DOCUMENTS

ES 2377630 A1 * 3/2012 ..... B65B 5/101
ES 2377630 B1 11/2012
IT SA20120010 A1 1/2014

OTHER PUBLICATIONS

European Search Report for Application No. 22382924.3, dated Apr. 20, 2023, 8 pages.

(Continued)

*Primary Examiner* — Jacob A Smith
(74) *Attorney, Agent, or Firm* — CANTOR COLBURN LLP

(57) ABSTRACT

A method of loading products into a box includes the following steps displacing the box into a loading station;

displacing a first group of products so as to position the first group of products above the box, in the loading station;

inserting the first group of products into the box;

shifting the box in a first direction while preventing the first group of products from moving with the box, so as to bring the first group of products towards the first side wall of the box so as to form a first row of products; and inserting further groups of products into the box so as to form an array of products in the box. A system for carrying out the method is related.

15 Claims, 7 Drawing Sheets

(58) Field of Classification Search
USPC ..... 53/457, 543, 147, 449, 448, 171, 202, 53/235
See application file for complete search history.

(56) References Cited

OTHER PUBLICATIONS

International Search Report for Application No. PCT/EP2023/076961, dated Jan. 22, 2024, 3 pages.
Written Opinion for Application No. PCT/EP2023/076961, dated Jan. 22, 2024, 8 pages.

* cited by examiner

METHOD AND SYSTEM FOR PLACING PRODUCTS IN BOXES

CROSS-REFERENCE TO RELATED APPLICATIONS

This application is a 35 U.S.C. § 371 National Stage patent application of PCT/EP2023/076961 filed 28 Sep. 2023, which claims the benefit of European patent application 22382924.3 filed 3 Oct. 2022, the dis-closures of which are incorporated herein by reference in their entirety.

TECHNICAL FIELD

The present disclosure relates to a method and system for placing products in boxes, such as cardboard boxes.

BACKGROUND

It is known in the art to place individual products in boxes, such as cardboard boxes, for transportation and storage of the products. For example, edible items such as fruits and vegetables are often placed in individual packages, such as on trays or in boxes or nets, which are then placed in a larger box, such as a cardboard box, to facilitate the subsequent handling, such as temporary storage and transportation, of the individual packages.

Typically, the boxes in which the individual packages/products are placed have a rectangular layout, with a rectangular bottom and four side walls extending upwards from the rectangular bottom. An upper opening is defined between the side walls of the box. Often, this upper opening does not extend all the way between the side walls of the box: instead, the upper opening of the box is partially restricted by horizontal flaps extending between the side walls of the box at the ends of the box (typically, at the two narrower ends of a box having two longer and two shorter sides), or by horizontal flaps present at the corners of the box. Thus, the area of the opening is smaller than the area of the bottom of the box between the side walls of the box. The flaps are typically provided for the purpose of enhancing the stability and/or rigidity of the box, and/or to provide for support surfaces allowing for, or at least facilitating, the stacking of boxes on top of each other.

Often, products such as packages (nets, trays—such as trays wrapped in some kind of foil—or boxes) containing fruits, vegetables, eggs or other edible items, are placed in arrays in the boxes, that is, extending in rows and columns on the bottom of the box. For efficiency, it is desirable that the products occupy as much as possible of the surface area of the bottom of the box, between the four side walls of the box. As the products are typically placed into the box from above, a problem here is that part of the storage space in the box is situated under the above-mentioned horizontal flaps. Thus, if the boxes are filled by merely letting the products descend into the boxes, the space under the flaps will not be used, which implies a suboptimal use of the surface area available for storage of the products within the boxes. Thus, typically, filling of the products into the boxes involves a horizontal movement of at least some of the products, so as to position at least some of the products at least partially under one or more of the flaps.

One example of the kind of box discussed above is shown in FIG. 1A. The box 1000 has a substantially parallelepipedal shape and comprises two short side walls 1001, 1002 and two long side walls 1003, 1004, the long side walls extending perpendicularly to the short side walls. The box has a bottom 1005 extending between the side walls 1001, 1002, 1003 and 1004. The surface area of the bottom of the box is basically L*W, where L is the length of a long side wall and W is the length of a short side wall. Any reference to the "length" of a side or side wall in this document relates to the extension thereof in the horizontal direction, that is, in parallel with the bottom of the box.

The upper free surface of the bottom between the side walls represents the surface that is available for the placement of products on the bottom of the box. The illustrated box has a relatively low height. This kind of boxes are sometimes also referred to as "trays" in the art. This kind of boxes are often prepared by folding a cardboard blank.

The box features an opening 1006 above the bottom of the box. The opening allows for the insertion of products into the box. The size of the opening is smaller than the surface of the bottom of the box, due to the presence of two substantially horizontal flaps 1000A, 1000B, each flap extending along the upper end of a respective short side wall or side 1001, 1002 of the box.

FIG. 1B illustrates the box 1000 filed with products, in this case, approximately parallelepipedal packages (which may contain fruit or any other kind of merchandise). The products are arranged in a 3×2 array, with a first row comprising two products 2001, 2002, a central row comprising two products 2005, 2006, and a final row comprising two products 2003, 2004. The products 2001, 2002 of the first row are partially arranged under a first flap 1000A of the box, and the products 2003, 2004 of the final row are partially placed under a second flap 1000B of the box. The products are tightly packed and basically occupy the entire surface of the bottom of the box, thus making efficient use of the available bottom surface area.

FIG. 1C shows another typical box layout known in the art. Here, the box 1000 has four flaps 1000C, 1000D, 1000E and 1000F in correspondence with respective corners of the box. The box is filed with products (such as trays), whereby some of the products are partially located under a respective one of the flaps. For example, in a first row of products, a first product 2001 is partially placed under a first one of the flaps 1000C, and a second product 2002 is partially placed under a second one of the flaps 1000D.

Sometimes this kind of boxes are filled manually. In such cases, an operator may manually push or shift some of the products towards an end of the box so that the products are at least partially placed under one or more flaps present at the respective end of the box. However, obviously, manual labor involves drawbacks, such as labor costs and the need to always have sufficient operators available for carrying out the work.

It is also known to use different kinds of robot devices for filing boxes with products, including robots capable of displacing the products along different axes, for example, one axis perpendicular to the bottom of a box and one or two axes parallel with the bottom of the box, so as to position each product at a specific location in relation to the walls of the box. For example, in the case of boxes such as those illustrated in FIGS. 1A-1C, a robot could first lower a product 2001 into the box from above, through the upper opening, and thereafter shift the product in parallel with the bottom of the box so as to position it, for example, at a corner of the box, partially under a flap 1000A, 1000C . . . . However, apart from the expenses involved with the robot as such, for proper operation it is often necessary to ensure a very precise positioning of the box in relation to the robot. Also, the robot typically needs to be specifically programmed for each kind of box and for each kind of product that is to be placed in the box. For example, when changing from products to be arranged in a 3×2 array to products to be arranged in a 3×4 array, or when changing from a layout as per FIG. 1B to a layout as per FIG. 1C, or when changing from one box size to another, complex reprogramming of the robot may be necessary.

ES-2377630-B1 discloses a system for loading products into a box. The system includes two devices that are arranged to be displaced in opposite directions by respective hydraulic or pneumatic actuators, in order to push products in opposite directions, towards respective opposite ends of the box.

US-2016/0059972-A1 discloses a rectangular article boxing method that includes: a step of erecting upright and aligning a bundle of rectangular articles, gripping, lifting, transferring, and lowering the bundle and inserting the bundle between a first guide and a second guide disposed at a predetermined interval in a carton; a step of displacing the first guide to above the upright bundle; a step of moving the inserted bundle to a position in contact with the existing bundle and holding the bundles with the second guide; a step of holding the upright bundles with the first guide in place of the second guide; and a step of displacing the second guide to a position at the predetermined interval from the first guide to receive the bundle to be conveyed next.

IT-SA-20120010-A1 discloses a system for introducing packages into a box. Two bulkheads operated by respective jacks are displaced in opposite directions so as to transfer packages towards respective opposite ends of the box.

SUMMARY

A first aspect of the disclosure relates to a method of loading products into a box having a substantially rectangular cross section in a horizontal plane, the box comprising a first side wall, a second side wall, a third side wall and a fourth side wall, the side walls extending upwards from the bottom of the box, wherein the method comprises:

- displacing the box along a first track and into a loading station;
- displacing a first group of products along a second track, so as to position the first group of products above the box, in the loading station;
- inserting (for example, dropping) the first group of products (the expression "group of products" is to be interpreted broadly in the sense that it includes the option of a group being made up of one single product) into the box so as to position the first group of products on the bottom of the box;
- shifting the box in a first direction while preventing the first group of products from moving with the box, so as to bring the first group of products towards the first side wall of the box, optionally causing the first group of products to abut against the first side wall of the box, so as to form a first row of products at the first side wall (1001) of the box, that is, next to the first side wall, adjacent to the first side wall, may be even abutting against the first side wall;
- inserting further groups of products into the box so as to form an array of products in the box, the array comprising a plurality of rows of products.

In the present document, a row of products is to be understood to include at least one product, that is, the array of products is a M×N array, where M is the number of rows and N the number of columns, M≥2, N≥1. In many embodiments N≥2.

In this text, the terms "box" and "products" should be interpreted broadly. In any case, a specific kind of box encompassed by this term is a box, preferably a cardboard box, of the type that is typically used for the transportation and handling of groups products such as trays or packages with foodstuff, such as fruit and vegetables, or other kinds of merchandise. The bottoms of the boxes are typically relatively thin, such as with thicknesses of less than 1 cm, such as less than 5 mm. The boxes typically have sides that are longer than 25 cm and shorter than 100 cm. The height of the boxes is typically more than 5 cm but less than 60 cm.

The products typically have a height of more than 5 cm or 10 cm when resting on the bottom of the box. When referring to retainers in their "lower" position, in some embodiments this implies that the lower part of the retainer is placed not higher than 5 or 10 cm over the surface supporting the box, such as over the first conveyor of the system described below.

In some embodiments, the step of shifting the box in the first direction while preventing the first group of products from moving with the box is carried out so that the first group of products becomes positioned at least partly under at least one flap present at the first side wall of the box. For example, the first group of products may be arranged partly under a flap extending along the first side wall of the box, for example, one of the shorter side walls of a rectangular box, or under two flaps arranged at two corners of the box, at the first side wall of the box. The flap or flaps may correspond to one or more portions of the side wall that have been folded at a substantially right angle so as to extend substantially horizontally, in parallel with the bottom of the box.

In some embodiments, the step of inserting further groups of products into the box so as to form an array of products in the box comprises:

- displacing a second group of products along the second track so as to position the second group of products above the box in the loading station (the expression "second group of products" does not imply that this group of products must be the one that is inserted into the box immediately after the insertion of the first group of products; it is merely used to distinguish the "second group of products" from the "first group of products"; additional groups of products may have been loaded into the box after the first group of products but before the second group of products; however, in many embodiments the second group of products is loaded into the box immediately after the loading of the first group of products into the box);
- inserting (for example, dropping) the second group of products (the expression "group of products" is to be interpreted broadly in the sense that it includes the option of a group being made up of one single product) into the box so as to position the second group of products on the bottom of the box;
- shifting the box in a second direction opposite to the first direction while preventing the second group of products from moving with the box, so as to bring the second group of products towards the second side wall of the box, optionally causing the second group of products to abut against the second side wall of the box, so as to form a second row of products in the box, at the second side wall of the box. The second row of products may be partially placed under one or more flaps present at the second side wall of the box, such as one flap extending along the second side wall of the box, or two flaps present at the corners of the box at the second side wall of the box.

In some embodiments, preventing the first group of products from moving with the box, so as to bring the first group of products towards the first side wall of the box, is carried out using a first retainer which is displaceable between an upper position in which it is placed outside the box, and a lower position in which the first retainer is at least partially inserted into the box, so that the first retainer prevents the first group of products from moving with the box when the box is shifted in the first direction.

In some embodiments, the method comprises the step of placing the first group of products on a support in the loading station, the support being arranged to selectively adopt a support configuration for supporting a group of products in the loading station, and a release configuration for allowing the group of products to descend, such as to drop, into a box placed under the support, whereby the step of inserting the first group of products into the box comprises the step of setting the support into the release configuration.

In some embodiments, the first retainer comprises a plurality of vertical bars and the support comprises a plurality of horizontal bars for supporting products, wherein at least some of the horizontal bars are positioned between at least some of the vertical bars, whereby shifting the support from the support configuration to the release configuration comprises displacing the horizontal bars in relation to the vertical bars so that at least some of the horizontal bars slide between at least some of the vertical bars. That is, the vertical bars and the horizontal bars can be interleaved so that they cross each other, so that some or all or most of the vertical bars are placed between corresponding pairs of horizontal bars, and so that some or all or most of the horizontal bars are placed between corresponding pairs of vertical bars, such that switching the support between the release configuration and the support configuration involves sliding the horizontal bars horizontally between the vertical bars, and so that lowering and raising the first retainer into and out of the box, respectively, involves sliding the vertical bars between the horizontal bars. Similarly, in many embodiments, when the first retainer shifts between its upper position and lower position, at least some, all, or most of the vertical bars slide between corresponding ones of the horizontal bars. This provides for a simple configuration of the retainer and the support, allowing the support to carry out its release and support functions, and allowing the retainer to shift between its upper position and its lower position, without the support and the retainer interfering with each other. Also, in many embodiments, when there is a second retainer, what has been said about the first retainer and its relation to the horizontal bars of the support, also applies to the second retainer.

In some embodiments, the method comprises using a first retainer and a second retainer, each one of the first retainer and the second retainer being selectively positionable in an upper position and in a lower position, the method comprising setting the first retainer in its lower position to prevent the first group of products from moving with the box in the first direction at one stage of a loading process during which the second retainer is in its upper position, and by setting the second retainer in its lower position to prevent a second group of products from moving with the box in a second direction, opposite to the first direction, at another stage of the loading process, during which the first retainer is in its upper position.

In some embodiments, the step of shifting the box in a first direction comprises displacing the box with a box shifting device, the box shifting device being controllably displaceable (by means of any suitable drive means) in parallel with the first direction, the box shifting device being switchable between a deployed configuration in which the box shifting device can interact with a box in the loading station so as to shift the box in parallel with the first direction (that is, in the first direction or in the opposite direction), and a retracted configuration in which the box shifting device cannot interact with the box, thereby allowing boxes to be transported into and out of the loading station without interfering with the box shifting device. Thus, the box shifting device can be used for shifting the box in the first and second directions, during a process as described above. Using this kind of box shifting device rather than shifting the boxes back and forth using conveyor belts or similar can help to enhance shifting velocity, reduce the cycle time for the filling of the boxes, enhance accuracy (as the correct position of the box at each moment can be ensured, for example, by letting the box shifting device clamp the boxes) and/or to minimize the energy consumption of the system.

The box shifting device can typically comprise a horizontally displaceable support member that supports at least two clamp members intended to interact with opposite sides of a box. For example, the clamp members can be selectively switched between two different vertical positions, namely, one vertical position in which the clamp members are positioned at a height in which they can interact with the box, so as to hold or clamp the box between them, so that the box will move horizontally with the displaceable support member, and another vertical position which is above the top of the box or below the bottom of the box, so that the clamp members do not interfere with the box when the box moves into and out of the loading station. The term "clamp member" is to be interpreted broadly as any kind of item capable of abutting against the box, such as against a side of the box, thereby causing the box to be shifted when the box shifting device is displaced. In some embodiments, the clamp members are arranged to be displaced in an inclined manner when the box shifting device is switched between the retracted and the deployed position, so that the clamp members, at the same time as their vertical position is changed, also change their horizontal position. Thus, when moving into the deployed configuration of the box switching device, the clamp members will move towards the box so as to clamp the box between the clamp members, and when moving into the retracted configuration of the box switching device, the clamp members will move away from the box, releasing the box.

A further aspect of the disclosure relates to a system for loading products into a box having a substantially rectangular cross section in a horizontal plane (that is, a box as described above, comprising a first side wall, a second side wall, a third side wall and a fourth side wall, the first side wall facing the second side wall and the third side wall facing the fourth side wall, the box further comprising a bottom, the side walls extending upwards from the bottom), the system comprising:

- a first transport system (such as a conveyor) for displacing boxes along a first track, into a loading station for loading products into the boxes;
- a second transport system for displacing products along a second track and into the loading station;
- a support for supporting the products in the loading station, above the first track, the support being arranged to selectively adopt a support configuration for supporting a group of products in the loading station, and a release configuration for allowing the group of products to descend (typically, to drop) into a box placed on the first track, under the support;

a first retainer arranged in the loading station, the first retainer being displaceable between an upper position and a lower position; and a subsystem (such as a horizontally displaceable box shifting device, which may be switchable between a deployed configuration for interacting with a box in the loading station, such as for clamping the box so as to displace the box horizontally together with the box shifting device, and a retracted configuration in which the box shifting device does not interact with the box in the loading station) for shifting boxes horizontally in the loading station.

In some embodiments, the upper position is selected so that the first retainer, when in the upper position, will not interfere with a box passing below the first retainer on the first transport system, and the lower position is selected so that the first retainer, when in the lower position, will enter into a box positioned under the first retainer and on the first transport system, so that the first retainer can interfere with a product placed on the bottom of the box, so as to prevent the product from moving with the box when the box is being displaced in a first direction by the subsystem.

In some embodiments, the system further comprises a second retainer arranged in the loading station, the second retainer being displaceable between an upper position and a lower position (what has been said about the upper and lower position of the first retainer also applies to the second retainer, mutatis mutandis), the first retainer and the second retainer being arranged in parallel so that when a product is placed on the support, the product is placed between the first retainer and the second retainer, wherein the first retainer is displaceable to its lower position to prevent a product dropped into a box from the support from moving with the box when the box is being displaced in a first direction by the subsystem, and wherein the second retainer is displaceable to its lower position to prevent a product dropped into a box from the support from moving with the box when the box is being displaced in a second direction, opposite to the first direction, by the subsystem.

In some embodiments, the retainers can serve a double function: on the one hand they can ensure that the products are not displaced too far sideways when the support is switched to its release configuration, for example, when support bars on which the products are resting in the loading station are withdrawn horizontally from under the products, so as to cause the products to drop into a box placed under the support, on the first transport system, such as a first conveyor. On the other hand, the retainers can serve to interfere with the products when they have landed in the box, preventing the products from being displaced horizontally with the box, as described above, thereby causing the products to move to an end of the box when the box is shifted in the first direction—whereby the products are being retained by the first retainer—or in the second direction—whereby the products are being retained by the second retainer—, respectively, by the subsystem for shifting boxes horizontally.

In some embodiments, the support comprises a plurality of horizontally extending support members (such as bars) arranged to support products from below when the products are positioned in the loading station, wherein the support members are displaceable in the horizontal direction, so as to shift the support from the support configuration into the release configuration, and vice-versa.

In some embodiments, the first retainer (and, in many embodiments, also the second retainer) comprises a plurality of vertical bars, wherein at least some of the vertical bars are interleaved with at least some of the horizontally extending support members, so that at least some of the vertical bars con slide vertically between at least some of the horizontally extending support members when the first retainer is shifted between its upper and its lower position, and/or wherein at least some of the horizontally extending support members can slide horizontally between at least some of the vertically extending bars, when the support is shifted between its support configuration and its release configuration.

A further aspect of the disclosure relates to a system as described above, configured for carrying out the method as described above.

A further aspect of the disclosure relates to a system as described above, programmed for carrying out the method as described above.

BRIEF DESCRIPTION OF THE DRAWINGS

To complete the description and in order to provide for a better understanding of the disclosure, a set of drawings is provided. Said drawings form an integral part of the description and illustrate embodiments of the disclosure, which should not be interpreted as restricting the scope of the disclosure, but just as examples of how the disclosure can be carried out. The drawings comprise the following figures.

DETAILED DESCRIPTION OF THE DRAWINGS

Figure 2:
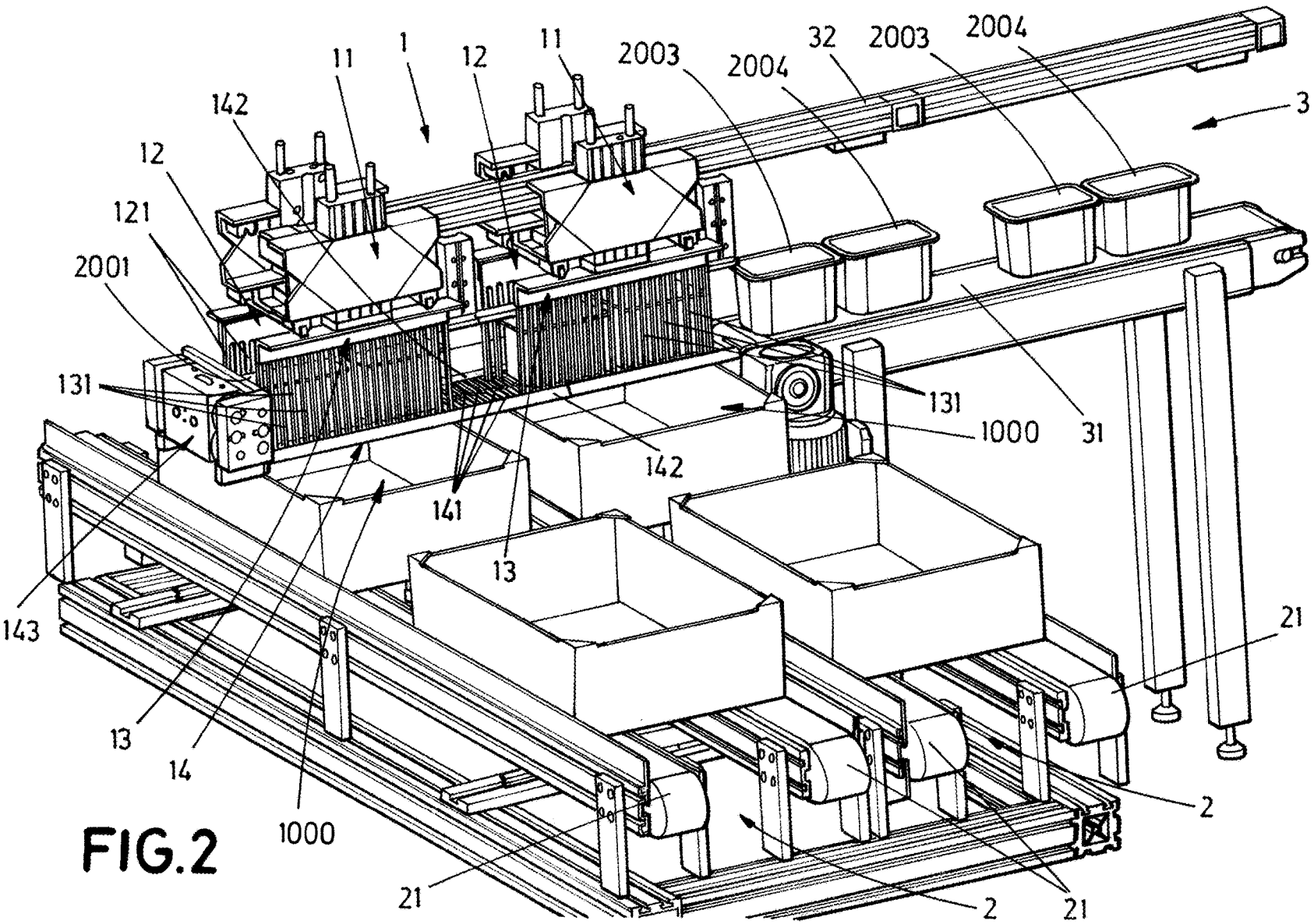
FIG. 2 is a schematic perspective view of some components of a system according to an embodiment of the disclosure.

FIG. 2 schematically illustrates a system according to one embodiment of the disclosure. Whereas some systems according to the disclosure may be arranged for loading products into one single box at each moment, the system of the embodiment illustrated in FIG. 2 is arranged for the simultaneous loading of products into a plurality of boxes 1000, in this case, into two boxes arriving to a loading station 1 on two parallel tracks 2. More specifically, the boxes are transported to the loading station 1, where products are dropped into the boxes, on two parallel tracks 2 ("first tracks") embodied as conveyors, each conveyor including two conveyor belts 21 on which the boxes are placed. The conveyer belts 21 are operated to move the boxes into and out of the loading station 1.

Figure 1A:
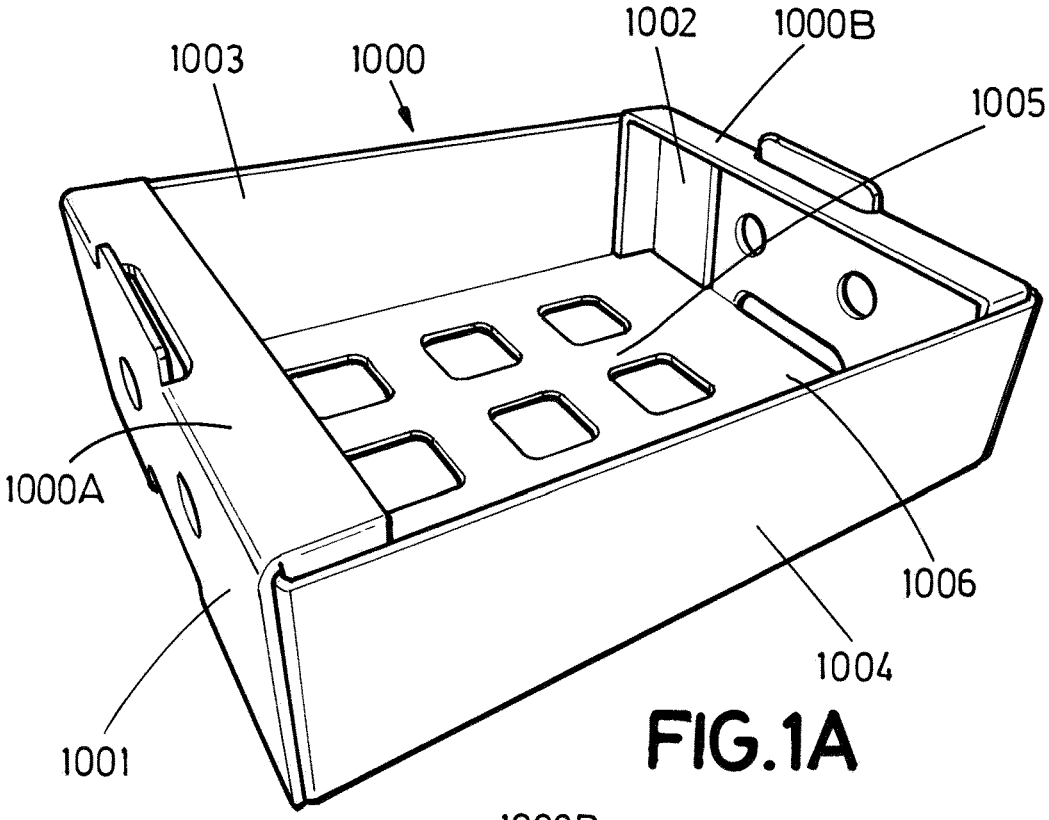
FIG. 1A is a perspective view of a box or tray for products such as packaged edible items, as known in the art.
Figure 1B:
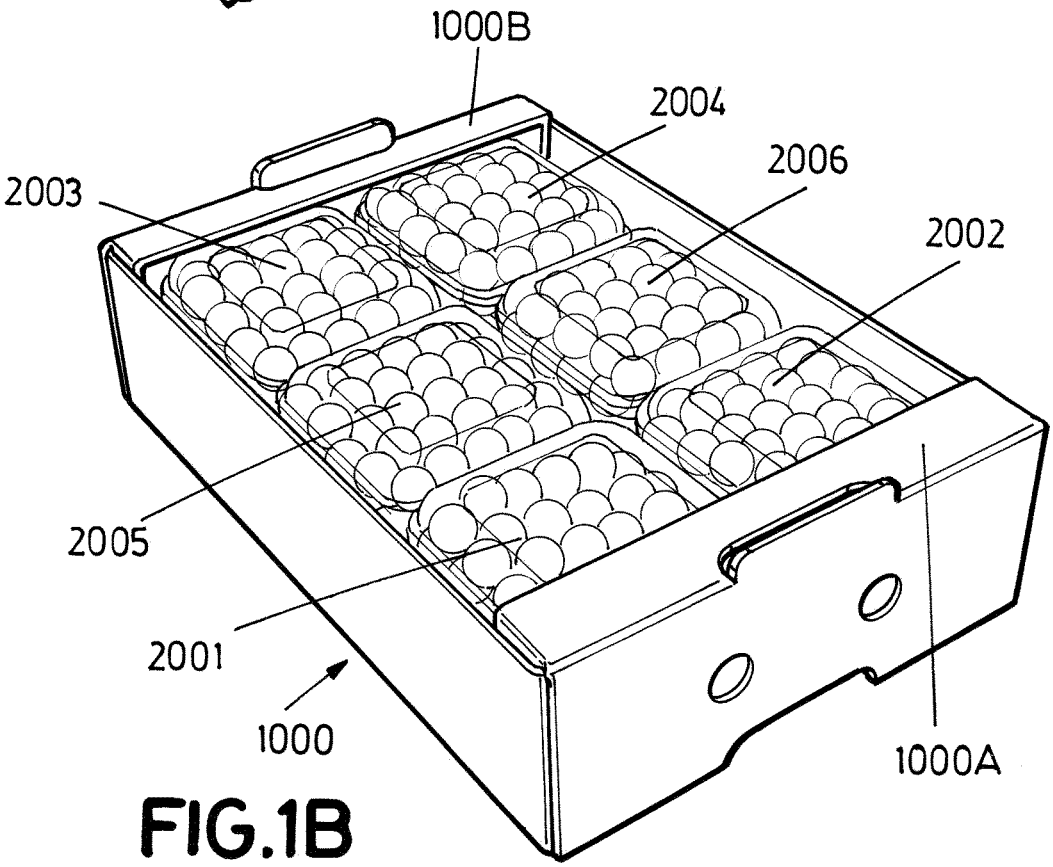
FIG. 1B is a perspective view of the box of FIG. 1, filled with packages containing, for example, fruit.
Figure 1C:
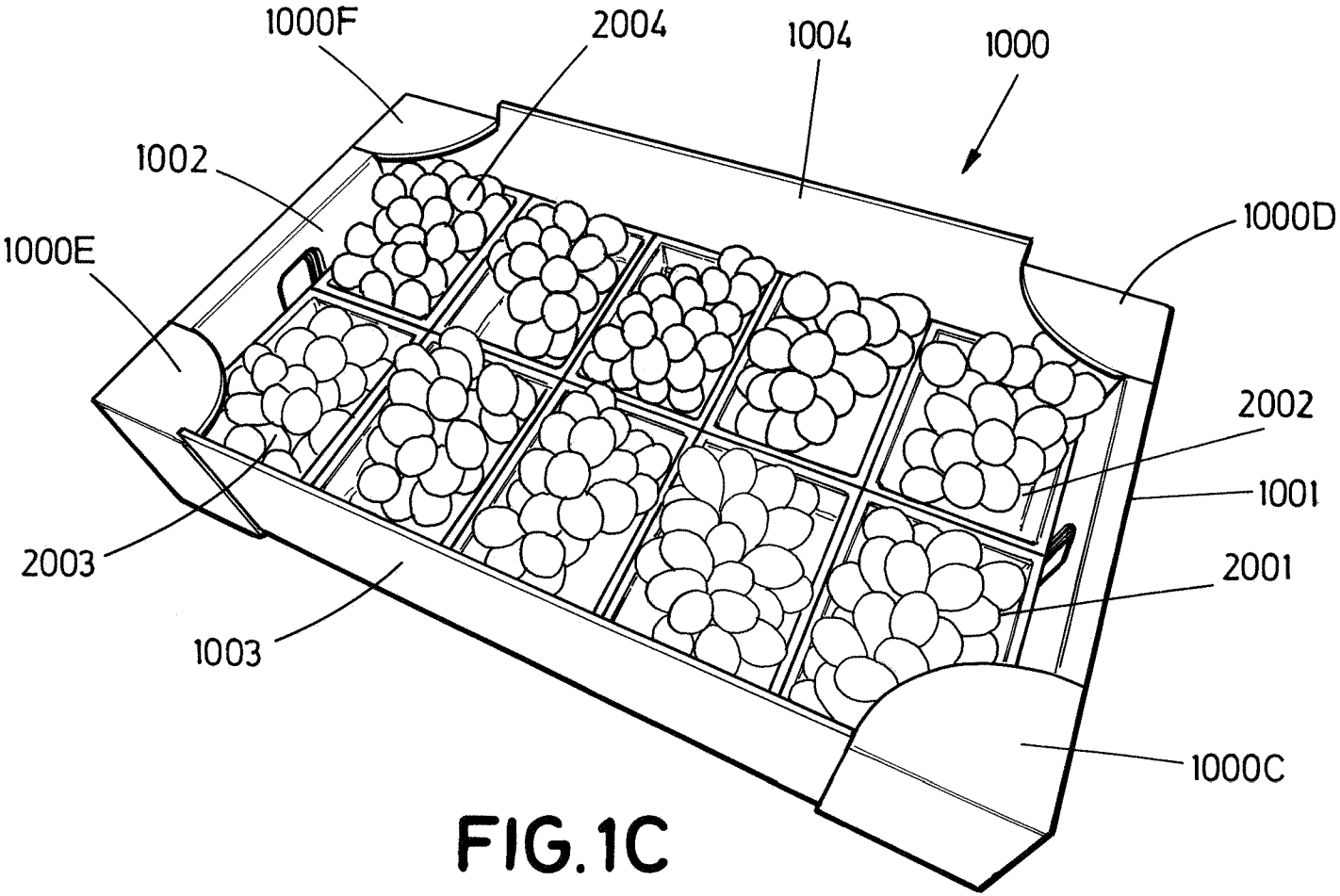
FIG. 1C is a perspective view of another kind of box known in the art, filled with trays containing, for example, fruit.

A plurality of products are transported into the loading station 1 along a second track 3 perpendicular to the first tracks 2 and situated in a plane above the plane of the first tracks 2, so as to position the products to be loaded into the boxes 1000 above the boxes. In FIG. 2 the system is currently handling the products in sets of four, each set comprising two products to be loaded into one of the two boxes 1000 present in the loading station 1, and two products to be loaded into the other one of the two boxes 1000. The second track 3 includes, in the embodiment of FIG. 2, a conveyor 31 for transporting the products towards the loading station 1. In FIG. 2, one set of four products (such as products 2001, 2002 of FIG. 1B or 1C) is present in the loading station, and another set of four products 2003, 2004 can be seen on the conveyor 31. The products arriving on the conveyor are shifted into the loading station 1 by means of a shifting arrangement that is not specifically illustrated in FIG. 2. Any kind of shifting arrangement can be used, for example, involving pick and place devices displaceable on a beam member 32 extending in parallel with the second track, or any other kind of device. In some embodiments, the products can simply be pushed from the conveyor 31 and into the loading station 1.

In the illustrated embodiment, there are two retention systems 11, each retention system 11 comprising a first retainer 12 and a second retainer 13, and controllable drives for controlled vertical displacement of the retainers 12, 13 between an upper position and a lower position. In the illustrated embodiment, the first retainer 12 comprises a plurality of vertical bars 121 and the second retainer 13 comprises a plurality of vertical bars 131. In the illustrated embodiment the retainers are only displaceable in the vertical direction, but in other embodiments the retainers may also travel horizontally, for example, during the shifting of products from the conveyor 31 into the loading station 1. Whereas in the illustrated embodiments the retainers involve vertical bars, in other embodiments the retainers may be configured differently, for example, as simple grids or plates, with our without openings. Any kind of retainer can be used that is capable of carrying out the product retention function necessary for shifting the products on the bottom of the box by retaining the products when the box is moved, so as to cause products to be at least partially positioned under a flap of the box.

In the loading station 1 of the illustrated embodiment, the products are supported on a support 14 comprising a plurality of support bars 141 extending horizontally inwards from two parallel beams 142 that extend horizontally in parallel with the conveyor 31 and perpendicularly to the first tracks 2 and its conveyor belts 21. The beams 142 are controllably displaceable between a support position (as in FIG. 2) where the horizontal support bars 141 are relatively close to each other and optionally interleaved with each other, so that the horizontal support bars serve to support the products from below, and a release position (as in FIG. 3) where the horizontal support bars 141 are substantially spaced from each other, so that they no longer support the products from below, thus allowing the products to descend into the respective box 1000, optionally guided by the vertical bars 121, 131 of the retainers 12, 13. A mechanism 143 for displacing the beams 142 between the support position and the release position is schematically illustrated in FIG. 2.

Figure 3:
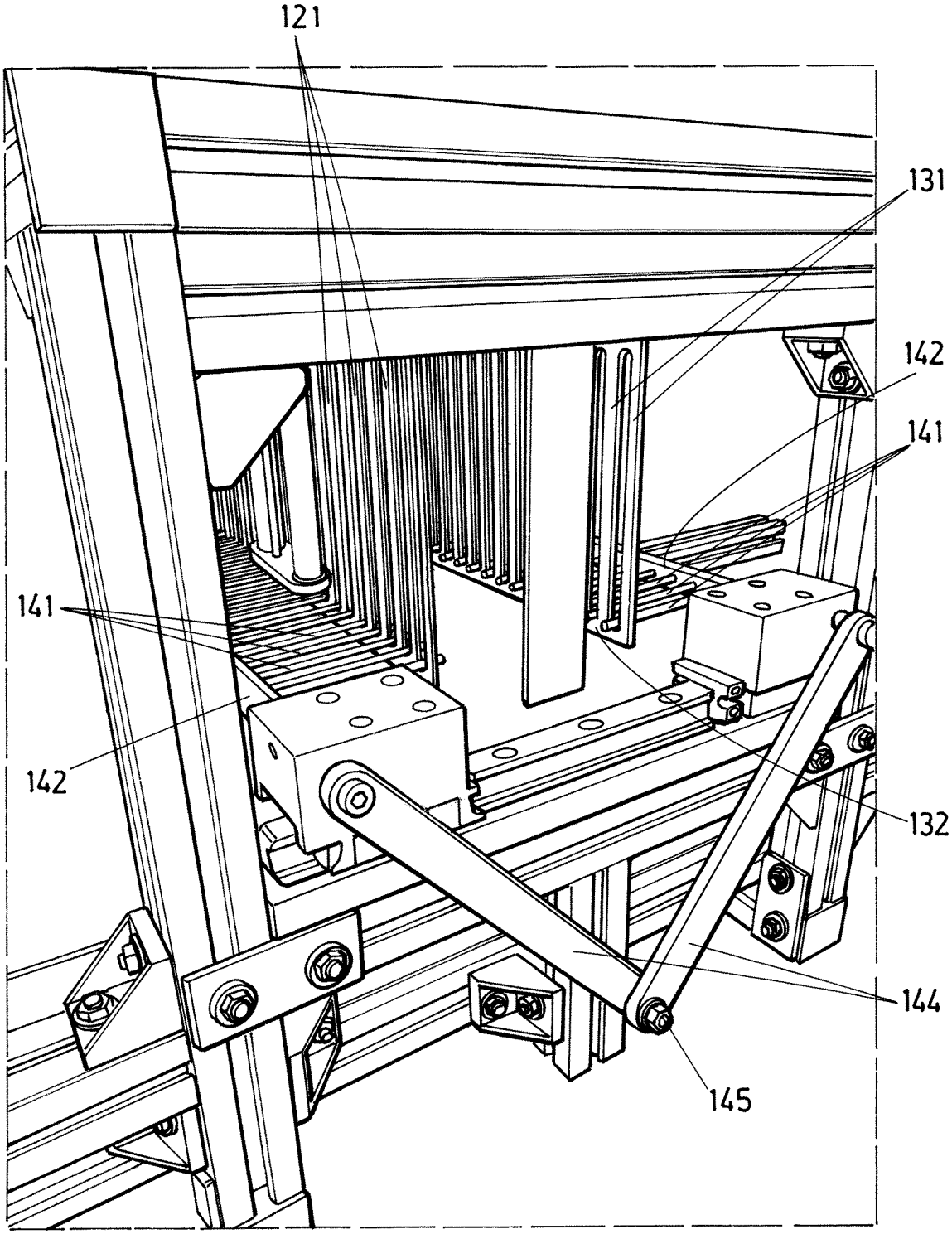
FIG. 3 is a schematic perspective view of a portion of one possible implementation of the embodiment of FIG. 2.

FIG. 3 shows one possible implementation of the embodiment of FIG. 2. It can be observed how the vertical bars 121, 131 of the retainers and the horizontal support bars 141 are interleaved, so that the vertical bars 121, 131 (or at least most of them) extend vertically between corresponding pairs of horizontal support bars 141, and the horizontal support bars 141 (or most of them) extend horizontally between corresponding pairs of vertical bars 121, 131 of the retainers 12, 13. Thus, the retainers 12, 13 are displaceable in the vertical direction with their bars 121, 131 sliding between the corresponding horizontal support bars 141, and the horizontal support bars 141 are displaceable in the horizontal direction, sliding between the corresponding vertical bars 121, 131. In FIG. 3 the beams 142 of the support are in the release position, that is, the horizontal support bars 141 corresponding to the two beams 142 are spaced from each other so as to allow a product (not shown) placed between the bars 121, 131 of the retainers to descend, that is, to drop from the support 14 and into the box 1000 placed under the support. FIG. 3 schematically illustrates part of one possible mechanism for shifting the beams 142 between their support position (in which the support bars 141 extending inwards from the two beams 142 are close to each other, serving to support a product placed between the bars 121, 131 of the retainers) and the release position shown in FIG. 3. The mechanism includes two rods 144 pivotably linked to each other at a joint 145. Vertical displacement of this joint 145 can serve to shift the beams 142 between the support position and the release position. However, any other suitable arrangement can be used. In FIG. 3 the retainers and their vertical bars 121, 131 are in their upper position. In the embodiment shown in FIG. 3, the vertical bars 121, 131 have their lower ends interconnected by a horizontally extending member (only one of which 132 is shown in FIG. 3) which, when the retainers are in their upper position, is placed just beneath the horizontal support bars 141.

In this embodiment, for loading products into a box 1000 positioned in the loading station 1, one of the retainers 12, 13 may be displaced vertically downwards (for the purpose which will be explained below), and the beams 142 are shifted to their release position, so that the horizontal support bars 141 slide away from each other, thereby releasing the products, which will thus drop into the box (in the "double track" embodiment shown in FIG. 2, products will simultaneously drop into the two boxes; however, for simplicity, the following discussion will only refer to what happens with one of the two boxes). Thereafter, the products can be shifted towards an end of the box, as will be now be explained with reference to FIGS. 4A-4D.

FIGS. 4A-4D schematically illustrate one possible embodiment of the disclosure, in which a plurality of groups of products are loaded into a box forming an array of products comprising three rows and two columns. The products are loaded into a rectangular box 1000 having two longer and two shorter side walls, a first one of the shorter side walls forming a first end of the box, and a second one of the shorter side walls forming a second end of the box. Flaps are present at the corners of the box: two flaps 1000C, 1000D are present at one end of the box, and two flaps 1000E, 1000F are present at the other end of the box, in respective corners of the box.

Figure 4A:
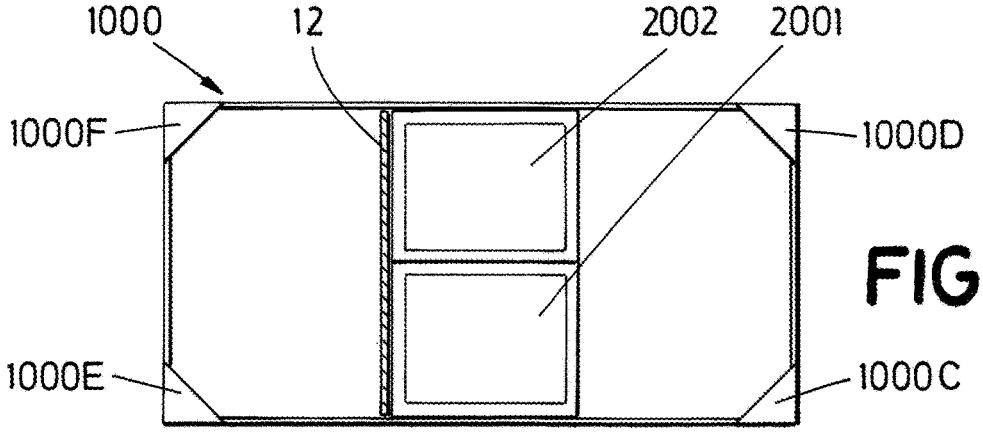
FIGS. 4A-4D are schematic top views of a box and products being filled into the box at different stages of a method according to one embodiment of the disclosure.

In FIG. 4A, a first group of products 2001, 2002 has been inserted (dropped) into the box 1000 from above. The box is in the loading station (for example, in a loading station as shown in FIG. 2), and the first retainer 12 has been lowered to its lower position, in which the first retainer 12 is at least partially inserted into the box, for example, so that the bottom of the first retainer 12 is close to the bottom of the box. The second retainer 13 is remaining in its upper position, above the vertical plane corresponding to the upper end of the box (and the second retainer 13 is thus not visible in FIG. 4A). The beams 142 of the support 14 have been displaced from their support position to their release position, allowing the products 2001, 2002 to drop into the box.

Thus, FIG. 4A schematically illustrate the box 1000 with the first group of products 2001, 2002 positioned within the box after dropping into the box, and with the first retainer 12 in its lower position, adjacent to the first group of products.

Figure 4B:
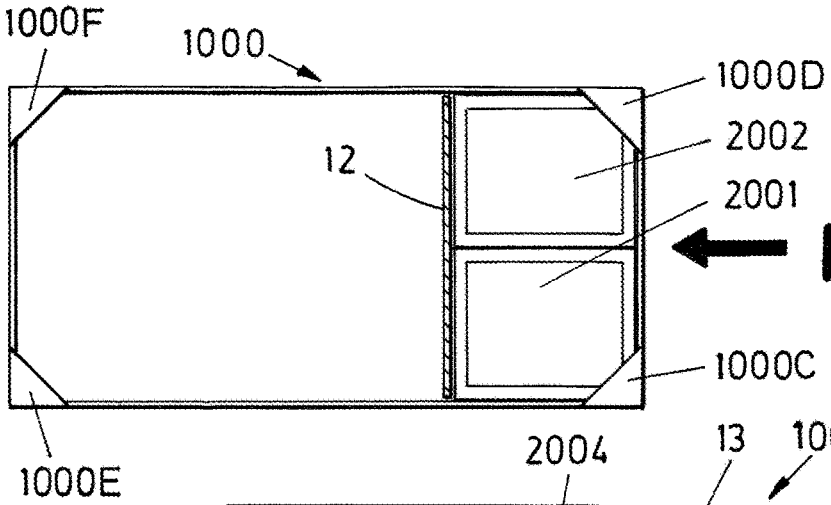
Figure 5:
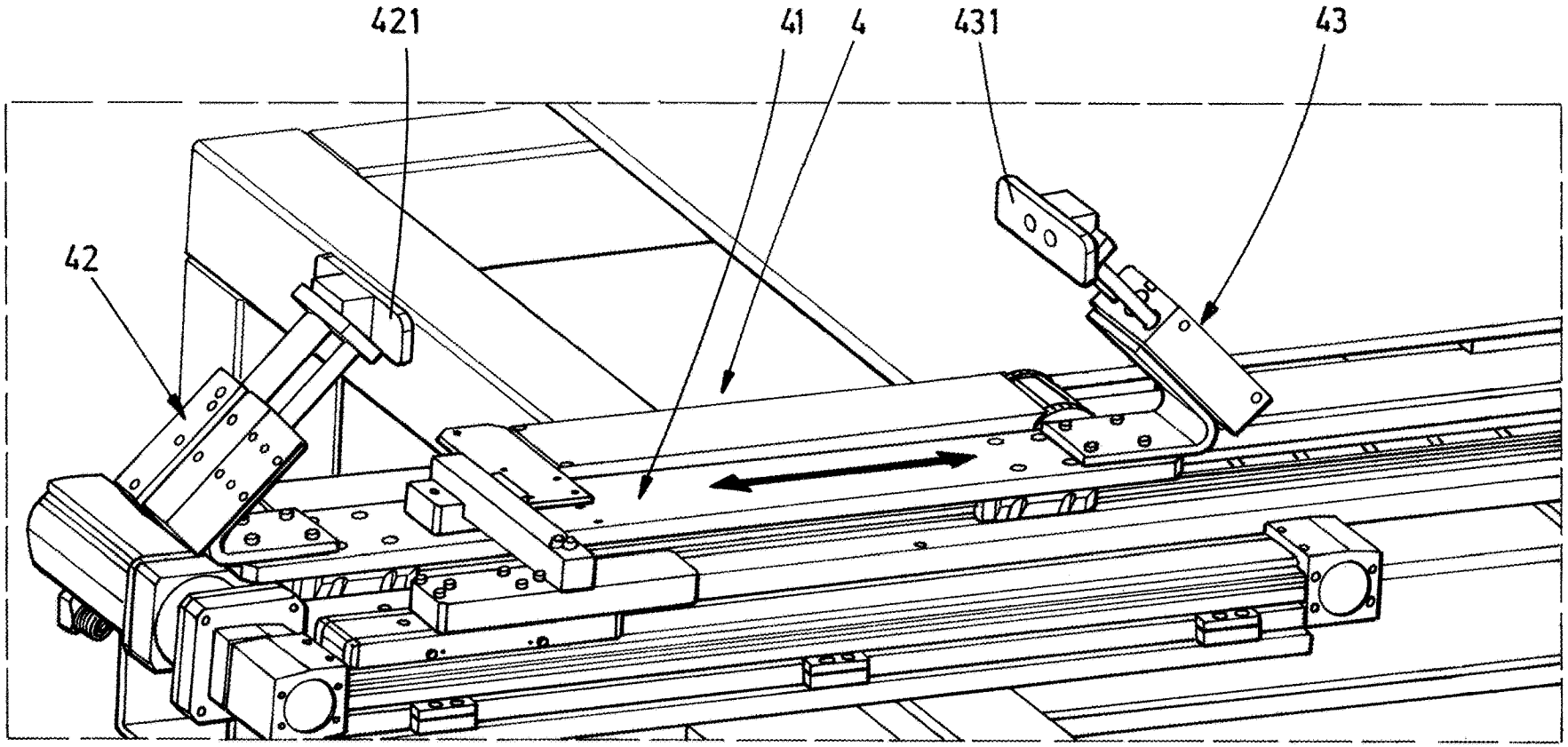
FIG. 5 is a schematic perspective view of part of one possible implementation of the embodiment of FIG. 2, including a box shifting device.

Next, the box 1000 is shifted in a first direction (according to the arrow shown in FIG. 4B), such as forwards on the conveyor, such as by a horizontally displaceable box shifting device, for example, a box shifting device as schematically illustrated in FIG. 5 (see the discussion of this figure below). The first direction is such that the first retainer 12 retains the first group of products 2001, 2002 and, due to the movement of the box 1000 in the first direction, causes the first group of products to slide towards an end of the box (such as a "rear" end of the box, if the first direction is "forwards"), until they are close to or even abutting against the end of the box. At the end of the movement of the box in the first direction, the first group of products 2001, 2002 is placed in correspondence with the relevant end of the box, and partially under the flaps 1000C, 1000D. This position is shown in FIG. 4B.

Figure 4C:
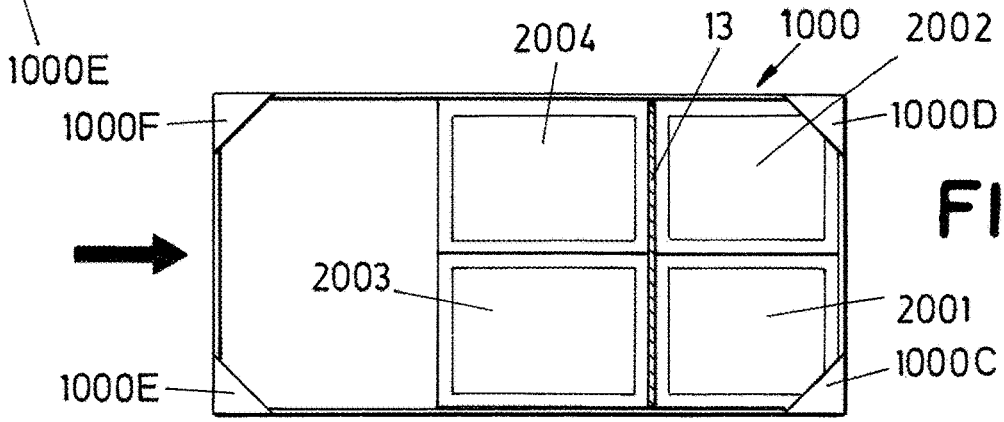

Next, the box is shifted in a second direction (such as "backwards", see the arrow in FIG. 4C), opposite to the first direction, for example, by horizontal movement of a box shifting device such as the one schematically illustrated in FIG. 5, so that the box returns to the position that it occupied in FIG. 4A. Next, the first retainer 12 is displaced vertically upwards to its upper position, and the second retainer 13 is displaced downwards to its lower position. A second group of products 2003, 2004 is dropped into the box, as shown in FIG. 4C.

Figure 4D:
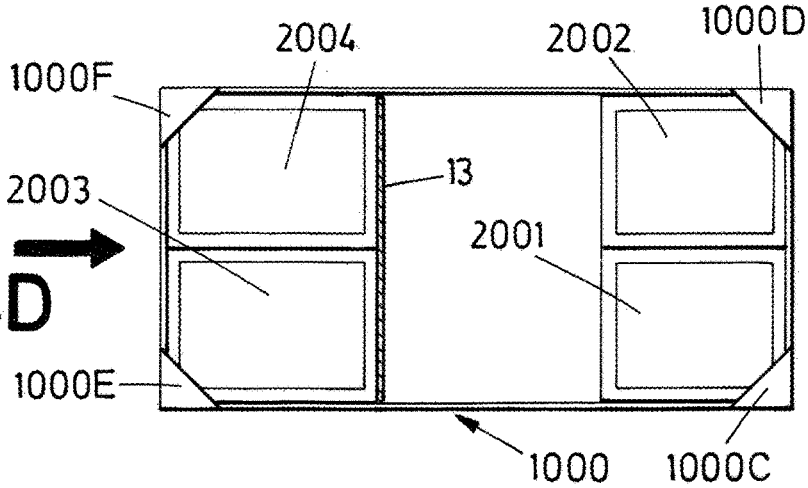

Next, the box is shifted in the second direction (for example, by operating the box shifting device, see the arrow in FIG. 4D), whereby the second retainer 13 will cause the second group of products 2003, 2004 to be displaced towards the end of the box opposite the end that is occupied by the first group of products 2001, 2002, for example, until the second group of products abut the end of the box, partly positioned under the corresponding flaps 1000E, 1000F, as shown in FIG. 4D.

Thereafter, the second retainer 13 may be raised. In a subsequent step, not illustrated in FIGS. 4A-4D, and after returning the box to the position that it occupied in FIGS. 4A and 4C, a third group of products can be deposited in the box, between the first group of products and the second group of products, thereby completing a 3×2 array of products in the box.

FIG. 5 schematically illustrates part of one possible implementation of the embodiment shown in FIG. 2. At each of the first tracks 2, a box shifting device 4 is arranged between the two conveyor belts 21 (not shown in FIG. 5), under the first track so that the box shifting device 4 will be positioned under the corresponding box when the box is in the loading station 1, resting on the conveyor belts 21.

The box shifting device comprises a horizontally displaceable support member 41 on which two box clamping devices 42 and 43 are mounted. Each box clamping device comprises a clamp member in the form of a plate 421, 431 arranged to abut against a respective one of two opposite side walls of the box, such as side walls 1001, 1002 of a box as per FIG. 1B or 1C. The box shifting device can selectively be switched between a deployed configuration in which the plates 421, 431 are positioned above the level of the upper surfaces of the conveyor belts 21, and a retracted configuration in which the plates 421, 431 are positioned below the upper surfaces of the conveyor belts 21. As can be understood from FIG. 5, the plates are displaced by an axial movement of the rods that support the plates, which are inclined in the vertical plane parallel with the conveyors, so that the plates 421, 431, when switched from their retracted position to their deployed position, also move horizontally, towards the respective sides of the box, so as to clamp the box between them. Thus, when in the deployed configuration, the plates 421, 431 interact with the side walls of a box placed on the conveyor belts, clamping or holding the box between the plates 421, 431, so that when the support member 41 is shifted in the horizontal direction in parallel with the conveyor belts, the box will likewise be shifted by the same distance. Thus, the box shifting device 4 can serve to carry out the different movements of the box that have been described with reference to FIGS. 4A-4D. In the retracted configuration, the plates 421, 431 are withdrawn so that they become situated under the support surface of the conveyor belts 21, so that the box shifting device will not interfere with the boxes when they are transported into and out of the loading station 1 on the conveyor belts 21. Any kind of suitable drive means or actuators can be used to shift the plates 421, 431 between their positions in the deployed configuration and their positions in the retracted configuration, and any kind of drive means or actuator can be used to shift the support member 41 horizontally.

Figure 6:
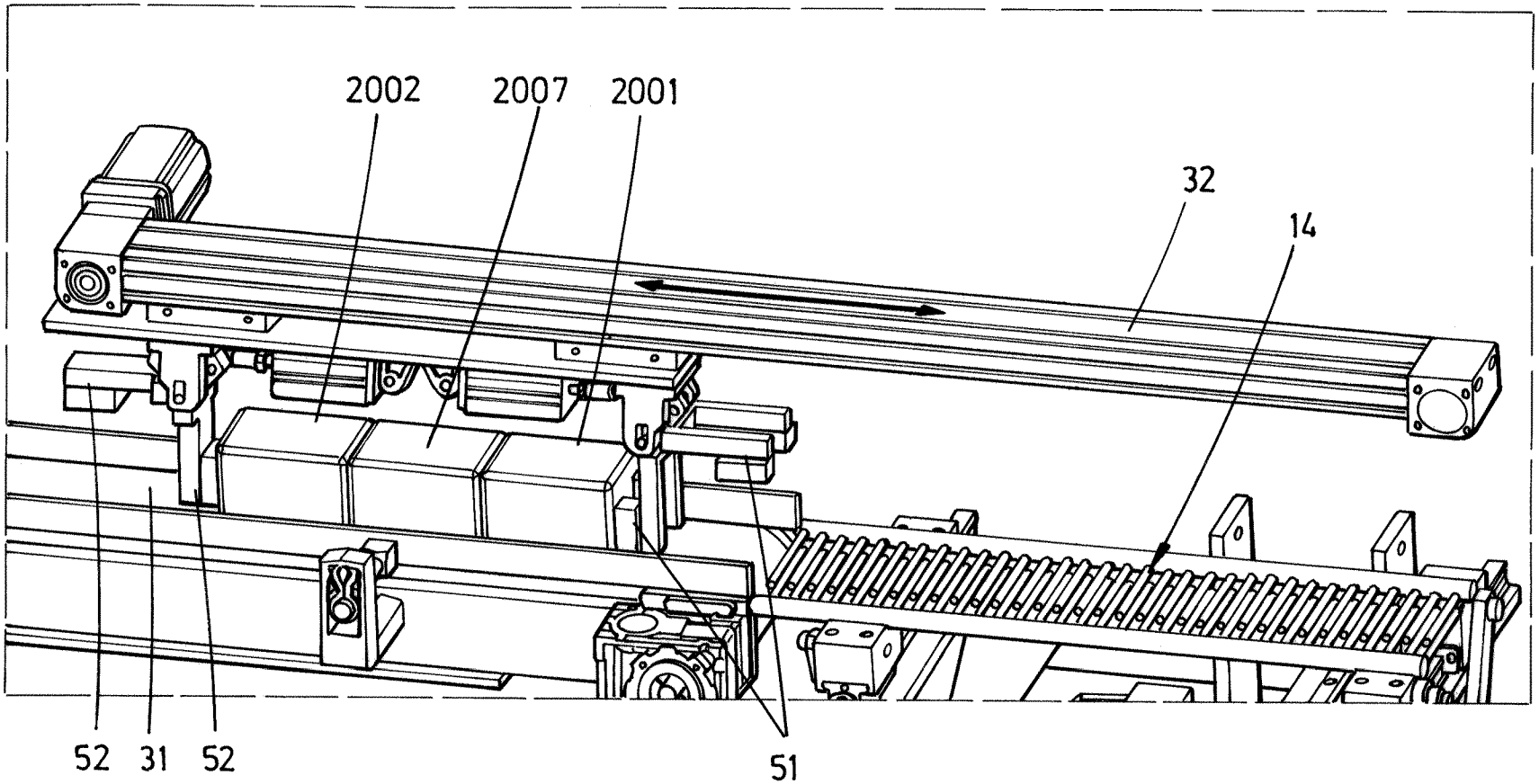
FIG. 6 is a schematic perspective view of part of one possible implementation of the embodiment of FIG. 2, including a subsystem for shifting products into the loading station.

FIG. 6 schematically illustrates an example of how a group of products (in this case comprising three products 2001, 2007, 2002, intended to be placed so as to form a row of products in a box) can be transferred from the conveyor 31 of the embodiment of FIG. 2, and onto the support 14. A product carrier 5 is arranged to shift the products from the conveyor 31 to the support 14, the product carrier being displaceable along the beam 32. As schematically illustrated, the product carrier 5 comprises clamping means 51, 52 arranged to clamp the group of products, so that the group of products can be lifted and then shifted in the horizontal direction, from the conveyor 31 and onto the support 14. In the implementation shown in FIG. 6, the clamping means 51, 52 are pivotable between their clamping position (vertical) and a release position (horizontal); for the purpose of illustration, in FIG. 6 the clamping means are shown both in their vertical and in their horizontal positions.

In this text, the terms "long" and "short" in the context of a box are merely intended to distinguish between the "longer" and "shorter" sides or side walls of a rectangular box, that is, they are not intended to denote that the sides are particularly "long" or "short".

In this document, the term "rectangular" is to be interpreted as including a square layout, that is, "rectangular" is not intended to rule out that all four sides may have the same length.

Terms such as "bar", "beam" etc. are to be interpreted in a broad sense, and in particular are not to be interpreted as implying any particular requisites in what regards the shape of their cross sections.

The terms "horizontally" and "vertically" are not to be interpreted in a mathematical sense, but rather as denoting that an element extends or is oriented substantially horizontally or vertically, respectively.

Whereas the methods and systems described and claimed herein may be especially suitable for the loading of products into boxes comprising horizontal flaps at their ends and/or corners (as described, for example, when discussing FIGS. 1A-1C), the methods and systems can of course also be used for the loading of products into boxes without such flaps.

In this text, the term "comprises" and its derivations (such as "comprising", etc.) should not be understood in an excluding sense, that is, these terms should not be interpreted as excluding the possibility that what is described and defined may include further elements, steps, etc.

The disclosure is obviously not limited to the specific embodiment(s) described herein, but also encompasses any variations that may be considered by any person skilled in the art (for example, as regards the choice of materials, dimensions, components, configuration, etc.), within the general scope of the disclosure as defined in the claims.

The invention claimed is:

1. A method of loading products into a box having a substantially rectangular cross section in a horizontal plane, the box comprising a first side wall, a second side wall, a third side wall and a fourth side wall, the side walls extending upwards from the bottom of the box, wherein the method comprises:

displacing the box along a first track and into a loading station;

displacing a first group of products along a second track, so as to position the first group of products above the box, in the loading station;

inserting the first group of products into the box so as to position the first group of products on the bottom of the box;

shifting the box in a first direction while preventing the first group of products from moving with the box, so as to bring the first group of products towards the first side wall of the box so as to form a first row of products at the first side wall of the box;

inserting further groups of products into the box so as to form an array of products in the box, the array comprising a plurality of rows of products.

2. The method according to claim 1, wherein the step of shifting the box in the first direction while preventing the first group of products from moving with the box is carried out so that the first group of products becomes positioned at least partly under at least one flap present at the first side wall of the box.

3. The method according to claim 1, wherein the step of inserting further groups of products into the box so as to form an array of products in the box comprises:

displacing a second group of products along the second track so as to position the second group of products above the box in the loading station;

inserting the second group of products into the box so as to position the second group of products on the bottom of the box;

shifting the box in a second direction opposite to the first direction while preventing the second group of products from moving with the box, so as to bring the second group of products towards the second side wall of the box so as to form a second row of products in the box, at the second side wall of the box.

4. The method according to claim 1, wherein preventing the first group of products from moving with the box, so as to bring the first group of products towards the first side wall of the box, is carried out using a first retainer which is displaceable between an upper position in which the first retainer is placed outside the box, and a lower position in which the first retainer is at least partially inserted into the box, so that the first retainer prevents the first group of products from moving with the box when the box is shifted in the first direction.

5. The method according to claim 4, comprising the step of placing the first group of products on a support in the loading station, the support being arranged to selectively adopt a support configuration for supporting a group of products in the loading station, and a release configuration for allowing the group of products to descend into a box placed under the support, whereby the step of inserting the first group of products into the box comprises the step of setting the support into the release configuration.

6. The method according to claim 5, wherein the first retainer comprises a plurality of vertical bars and wherein the support comprises a plurality of horizontal bars for supporting products, wherein at least some of the horizontal bars are positioned between at least some of the vertical bars, whereby shifting the support from the support configuration to the release configuration comprises displacing the horizontal bars in relation to the vertical bars so that at least some of the horizontal bars slide between at least some of the vertical bars.

7. The method according to claim 1, comprising using a first retainer and a second retainer, each one of the first retainer and the second retainer being selectively positionable in an upper position and in a lower position, the method comprising setting the first retainer in its lower position to prevent the first group of products from moving with the box in the first direction at one stage of a loading process during which the second retainer is in its upper position, and by setting the second retainer in its lower position to prevent a second group of products from moving with the box in a second direction, opposite to the first direction, at another stage of the loading process, during which the first retainer is in its upper position.

8. The method according to claim 1, wherein the step of shifting the box in a first direction comprises displacing the box with a box shifting device comprising a horizontally displaceable support member configured to support at least two clamp members intended to interact with opposite sides of the box, the box shifting device being controllably displaceable in parallel with the first direction, the box shifting device being switchable between a deployed configuration in which the box shifting device can interact with a box in the loading station so as to shift the box in parallel with the first direction, and a retracted configuration in which the box shifting device cannot interact with the box.

9. A system for loading products into a box having a substantially rectangular cross section in a horizontal plane, the system comprising:

a first transport system configured to displace boxes along a first track, into a loading station for loading products into the boxes;

a second transport system configured to displace products along a second track and into the loading station;

a support configured to support the products in the loading station, above the first track, the support being arranged to selectively adopt a support configuration for supporting a group of products in the loading station, and a release configuration for allowing the group of products to descend into a box placed on the first track, under the support;

a first retainer arranged in the loading station, the first retainer being displaceable between an upper position and a lower position; and a subsystem configured to shift boxes horizontally in the loading station.

10. The system according to claim 9, wherein the upper position is selected so that the first retainer, when in the upper position, will not interfere with a box passing below the first retainer on the first transport system, and wherein the lower position is selected so that the first retainer, when in the lower position, will enter into a box positioned under the first retainer and on the first transport system, so that the first retainer can interfere with a product placed on the bottom of the box, so as to prevent the product from moving with the box when the box is being displaced in a first direction by the subsystem.

11. The system according to claim 9, further comprising a second retainer arranged in the loading station, the second retainer being displaceable between an upper position and a lower position, the first retainer and the second retainer being arranged in parallel so that when a product is placed on the support, the product is placed between the first retainer and the second retainer, wherein the first retainer is displaceable to its lower position to prevent a product dropped into a box from the support from moving with the box when the box is being displaced in a first direction by the subsystem, and wherein the second retainer is displaceable to its lower position to prevent a product dropped into a box from the support from moving with the box when the box is being displaced in a second direction, opposite to the first direction, by the subsystem.

12. The system according to claim 9, wherein the support comprises a plurality of horizontally extending support members arranged to support products from below when the products are positioned in the loading station, wherein the support members are displaceable in the horizontal direction, so as to shift the support from the support configuration into the release configuration.

13. The system according to claim 12, wherein the first retainer comprises a plurality of vertical bars, and wherein at least some of the vertical bars are interleaved with at least some of the horizontally extending support members, so that at least some of the vertical bars can slide vertically between at least some of the horizontally extending support members when the first retainer is shifted between its upper and its lower position, and/or wherein at least some of the horizontally extending support members can slide horizontally between at least some of the vertically extending bars, when the support is shifted between its support configuration and its release configuration.

14. A system for loading products into a box having a substantially rectangular cross section in a horizontal plane, the system comprising a first transport system configured to displace boxes along a first track, into a loading station for loading products into the boxes; a second transport system configured to displace products along a second track and into the loading station; a support configured to support the products in the loading station, above the first track, the support being arranged to selectively adopt a support configuration for supporting a group of products in the loading station, and a release configuration for allowing the group of products to descend into a box placed on the first track, under the support; a first retainer arranged in the loading station, the first retainer being displaceable between an upper position and a lower position; and a subsystem configured to shift boxes horizontally in the loading station, configured for carrying out a method of loading products into the box, the box comprising a first side wall, a second side wall, a third side wall and a fourth side wall, the side walls extending upwards from the bottom of the box, wherein the method includes the following steps:

displacing the box along the first track and into the loading station;

displacing a first group of products along the second track, whereby the first group of products is positioned above the box, in the loading station;

inserting the first group of products into the box whereby the first group of products is positioned on the bottom of the box;

shifting the box in a first direction while preventing the first group of products from moving with the box, whereby the first group of products is moved towards the first side wall of the box and forms a first row of products at the first side wall of the box;

inserting further groups of products into the box whereby an array of products is formed in the box, the array comprising a plurality of rows of products.

15. A system for loading products into a box having a substantially rectangular cross section in a horizontal plane, the system comprising a first transport system configured to displace boxes along a first track, into a loading station for loading products into the boxes; a second transport system configured to displace products along a second track and into the loading station; a support configured to support the products in the loading station, above the first track, the support being arranged to selectively adopt a support configuration for supporting a group of products in the loading station, and a release configuration for allowing the group of products to descend into a box placed on the first track, under the support; a first retainer arranged in the loading station, the first retainer being displaceable between an upper position and a lower position; and a subsystem configured to shift boxes horizontally in the loading station, programmed for carrying out a method of loading products into a box having a substantially rectangular cross section in a horizontal plane, the box comprising a first side wall, a second side wall, a third side wall and a fourth side wall, the side walls extending upwards from the bottom of the box, wherein the method includes the following steps:

displacing the box along the first track and into the loading station;

displacing a first group of products along the second track, whereby the first group of products is positioned above the box, in the loading station;

inserting the first group of products into the box whereby the first group of products is positioned on the bottom of the box;

shifting the box in a first direction while preventing the first group of products from moving with the box, whereby the first group of products is moved towards the first side wall of the box and forms a first row of products at the first side wall of the box;

inserting further groups of products into the box whereby an array of products is formed in the box, the array comprising a plurality of rows of products.

* * * * *